US009107513B2

(12) United States Patent
Asfa

(10) Patent No.: US 9,107,513 B2
(45) Date of Patent: Aug. 18, 2015

(54) BABY WALKER SYSTEM WITH A BRAKING MECHANISM FOR MOVEMENT CONTROL

(71) Applicant: Amirmasood Asfa, Isfahan (IR)

(72) Inventor: Amirmasood Asfa, Isfahan (IR)

( * ) Notice: Subject to any disclaimer, the term of this patent is extended or adjusted under 35 U.S.C. 154(b) by 0 days.

(21) Appl. No.: 14/588,971

(22) Filed: Jan. 4, 2015

(65) Prior Publication Data

US 2015/0108731 A1 Apr. 23, 2015

(51) Int. Cl.
*A47D 15/00* (2006.01)
*A47D 13/04* (2006.01)

(52) U.S. Cl.
CPC ..... *A47D 15/00* (2013.01); *A47D 13/04* (2013.01)

(58) Field of Classification Search
CPC .... A47D 13/04; A61H 3/04; A61H 2003/046
USPC ..... 180/167–169; 280/87.051
See application file for complete search history.

(56) References Cited

U.S. PATENT DOCUMENTS 1,868,836 A * 7/1932 Lieb ..... 188/5
3,652,103 A * 3/1972 Higgs ..... 280/33.994
4,829,442 A * 5/1989 Kadonoff et al. ..... 701/23
5,253,882 A * 10/1993 Mitchell ..... 280/11.214
5,315,290 A * 5/1994 Moreno et al. ..... 340/568.5
5,342,072 A * 8/1994 Prasad ..... 280/87.051
5,377,106 A * 12/1994 Drunk et al. ..... 701/25
5,640,002 A * 6/1997 Ruppert et al. ..... 235/462.46
5,704,619 A * 1/1998 Mitchell et al. ..... 280/11.216
5,713,586 A * 2/1998 Haller ..... 280/87.051
5,722,503 A * 3/1998 Haller ..... 180/168
5,794,639 A * 8/1998 Einbinder ..... 135/67
5,865,445 A * 2/1999 Svensson et al. ..... 280/11.214
6,076,839 A * 6/2000 Pao-Hung ..... 280/87.051
6,352,234 B1 * 3/2002 Liu ..... 248/677
6,983,813 B1 * 1/2006 Wright ..... 180/11
7,237,298 B2 * 7/2007 Reindle et al. ..... 15/319
7,957,859 B2 * 6/2011 Young ..... 701/25
8,155,380 B2 * 4/2012 Ma et al. ..... 382/103
8,684,145 B2 * 4/2014 Boukhny et al. ..... 188/68
2002/0089140 A1 * 7/2002 Lu ..... 280/87.051
2004/0137898 A1 * 7/2004 Crandall et al. ..... 455/426.2
2005/0029029 A1 * 2/2005 Thorne ..... 180/167
2005/0065662 A1 * 3/2005 Reindle et al. ..... 701/1
2005/0279551 A1 * 12/2005 LoPresti ..... 180/167
2007/0057763 A1 * 3/2007 Blattner et al. ..... 340/5.52
2007/0067678 A1 * 3/2007 Hosek et al. ..... 714/25
2007/0091167 A1 * 4/2007 Shiina et al. ..... 348/14.01
2007/0235238 A1 * 10/2007 Sadegh et al. ..... 180/164
2010/0076631 A1 * 3/2010 Mian ..... 701/19
2011/0247903 A1 * 10/2011 Boukhny et al. ..... 188/68
2012/0191524 A1 * 7/2012 Ambrosio et al. ..... 705/14.23
2013/0088578 A1 * 4/2013 Umezawa et al. ..... 348/47
2014/0090948 A1 * 4/2014 Krishnarao et al. ..... 192/130

* cited by examiner

*Primary Examiner* — Brodie Follman
(74) *Attorney, Agent, or Firm* — Barry Choobin; Patent 360

(57) ABSTRACT

The various embodiments herein provide a baby walker with braking mechanism to control a movement of the baby walker from moving into dangerous areas. The baby walker comprises a sensor unit, a wave transmitter system, a braking system and a power supply unit. The sensor unit is configured to sense an obstacle in the way of walker. The wave transmitter system, in communication with the sensor unit, is configured to generate signals on sensing the obstacle. The braking system, in communication with the wave transmitter, is configured to control movement of the walker upon reception of signals from the wave transmitter. The power supply unit is configured to supply electric power to the sensor unit, the wave transceiver the braking system.

12 Claims, 6 Drawing Sheets

BABY WALKER SYSTEM WITH A BRAKING MECHANISM FOR MOVEMENT CONTROL

CROSS REFERENCE TO RELATED APPLICATION

The present application claims the benefit and the priority of the U.S. Provisional Patent application Ser. No. 61/846,983 filed on Jul. 16, 2013 with title, "SMART BABY WALKER WITH A BRAKE SYSTEM TO CONTROL THE BABY'S RANGE OF MOTION", and the contents of which is incorporated in its entirety as reference herein.

TECHNICAL FIELD

The embodiments herein generally relates to baby walkers. The embodiments herein particularly relates to a baby walker with a safety feature. The embodiments herein more particularly relates to a baby walker with a braking mechanism to avoid an obstacle in the walker's way.

DESCRIPTION OF THE RELATED ART

Baby walker is one of the ordinary facilities to help a toddler to start walking. The problem with a baby walker is a lack of control for the parents on the baby walker along the route the child goes and encounters the dangerous things like the heater and areas such as stairs. The problem of collision of the walker with the obstacle occurs when the parents are not available nearby or around to monitor a baby.

The baby walkers available in the present day market do not have the option of control during an encounter with dangerous areas. Some of the walkers have just a foot brake that stops the baby by the will of the parents. Among the patented inventions, the closest prior art invention is US patent numbered U.S. Pat. No. 6,983,813 entitled "remote controlled and motorized baby walker". The prior art patent discloses a baby walker with a motor and a remote control. Also the sensors on the walker prevent it from encountering the barriers. But the patent does not have any clear description about the brakes and the sensors electronic function.

Another German Patent numbered DE29814240 discloses a baby walker with a special brake and anti-slip instruments and does not provide any description about the used sensors.

Thus none of the baby walkers is provided with a baby walker to control the movement of the baby walker during the movement walker near dangerous or hazardous things like heaters, ponds, etc and areas like staircases, etc.

Hence there is a need for a baby walker with a braking mechanism to control a movement of the baby walker from walking into dangerous areas. Further there is a need for providing a safety and security system that is fitted to any existing baby walker system to prevent a movement of the baby walker into forbidden areas and to secure the baby walker from unpredicted dangers. Still further there is a need for a safety and security system for a baby walker which intimates the baby's parents on the obstacles that are present on the way of the baby walker.

The above mentioned shortcomings, disadvantages and problems are addressed herein and which will be understood by reading and studying the following specification.

OBJECTS OF THE EMBODIMENTS HEREIN

The primary object of the embodiments herein is to provide a baby walker with a braking mechanism to control a movement of the baby walker from moving into dangerous or hazardous areas.

Another object of the embodiments herein is to provide a baby walker provided with a security mechanism for alerting the parents in tricky or dangerous situations.

Yet another object of the embodiments herein is to provide a baby walker with automatic brakes to stop the baby walker.

Yet another object of the embodiments herein is to provide a baby walker with sensors and brakes which are fitted to the existing baby walkers without any main changes to the original structure of the walker.

Yet another object of the embodiments herein is to provide a baby walker with a plurality of sensors, lasers and cameras to secure the baby walker from unpredicted dangers.

SUMMARY

The various embodiments herein provide a baby walker with braking mechanism to control a movement of the baby walker from walking into dangerous areas. The baby walker comprises a sensor unit, a wave transmitter system, a braking system and a power supply unit. The sensor unit comprises a plurality of sensors configured to sense an obstacle in the way of walker. The wave transmitter system is in communication with the sensor unit and configured to generate signals on sensing the obstacle. The braking system is in communication with the wave transmitter and configured to control a movement of the walker upon the receipt of the signals from the wave transmitter. The power supply unit is configured to supply electric power to the sensor unit, the wave transceiver the braking system.

According to an embodiment herein, the sensor unit adopts infrared radiations to detect any obstruction to the walker.

According to an embodiment herein, the sensor unit comprises an infrared radiation (IR) transceiver, a flash light and a LED bulb. The infrared radiation (IR) transceiver is configured to generate the infrared rays and to receive the reflected infrared radiations from the obstacle. The flashlight is in communication with IR transceiver and configured to radiate infrared radiations in all possible directions. The flashlight radiates infrared radiations with an adjustable range of 5 cm to 50 cm. The LED bulb is configured to indicate on/off status of the sensor unit.

According to an embodiment herein, a plurality of sensor units are placed on the lower bumper of the walker for enabling a maximum detection of the obstacle. The plurality of sensor units is placed at unsafe surrounding places.

According to an embodiment herein, the sensor unit comprise different types of sensors such as metering sensor, thermal sensors, color sensitive sensors, subsonic sensors; lasers and cameras. The sensor unit further comprises different types of transmitters like infrared, radio and optical transmitters to maximize the detection of obstruction to the walker.

According to an embodiment herein, the wave transmitter comprises a processor configured to analyze the reflected infrared radiations and estimate various parameters pertaining to the obstacle and the walker.

According to an embodiment herein, the wave transmitter transmits an obstacle detection signal to the braking system depending on a distance between the walker and the obstacle. The wave transmitter transmits an obstacle detection signal to the braking system, when the walker gets too close to the obstruction. The wave transmitter further transmits a different signal such as a notification signal to braking system when the walker is moved away from the obstruction.

According to an embodiment herein, the wave transmitter generates a trigger signal to activate an alarm as soon as the brakes are applied to the walker. The alarm turns off when the walker is moved away from the obstacle.

According to an embodiment herein, the braking system comprises a main housing which forms a main body of the braking system, a brake blade configured to inhibit motion of the walker, a brake blade guiding rails to move the brake blade in up and down directions, a rotating disk for enabling the movement of the brake blades, a servomotor configured to control the spinning of the rotating disk and a connecting rod.

According to an embodiment herein, an end part of the brake blade that hits ground surface is covered with silicon or compact plastic for better friction and adherence of the two surfaces.

According to an embodiment herein, the braking system comprises a remote control designed in a way that the brakes are controlled according to the parents/guardian instructions.

According to an embodiment herein, the walker is equipped with a bluetooth system to enable the parents/guardian to check the position of the baby and lock or activate the brakes using electronic device including, but not limited to, cell phone, laptop and computer.

According to an embodiment herein, the power supply unit comprises a battery as a source of power supply, a charging port which is adopted to charge the battery of the walker and a plurality of LEDs to indicate the charging level of the battery.

The various embodiments herein provide a method providing braking mechanism to a baby walker. The method comprises the following steps: The infrared radiations generated by the IR transceiver are radiated in all directions through flashlight. The infrared radiations reflected from the obstacle are received by the IR transceiver. An intimation signal is generated by the wave transmitter and is transmitted to the braking system depending on the reflected radiations received from the IR transceiver. Upon receiving the signal from the wave transmitter, the brakes are applied on the wheels of the baby walker. Further an alarm is generated by the wave transmitter to intimate parents/guardians on the obstruction.

According to an embodiment herein, the detection or notification signal is generated depending on the distance between the baby walker and the obstacle.

According to an embodiment herein, a signal is generated by the wave transmitter to turn off the alarm, when the baby walker is pulled away from the obstacle.

These and other objects and advantages of the present invention will become readily apparent from the following detailed description taken in conjunction with the accompanying drawings.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
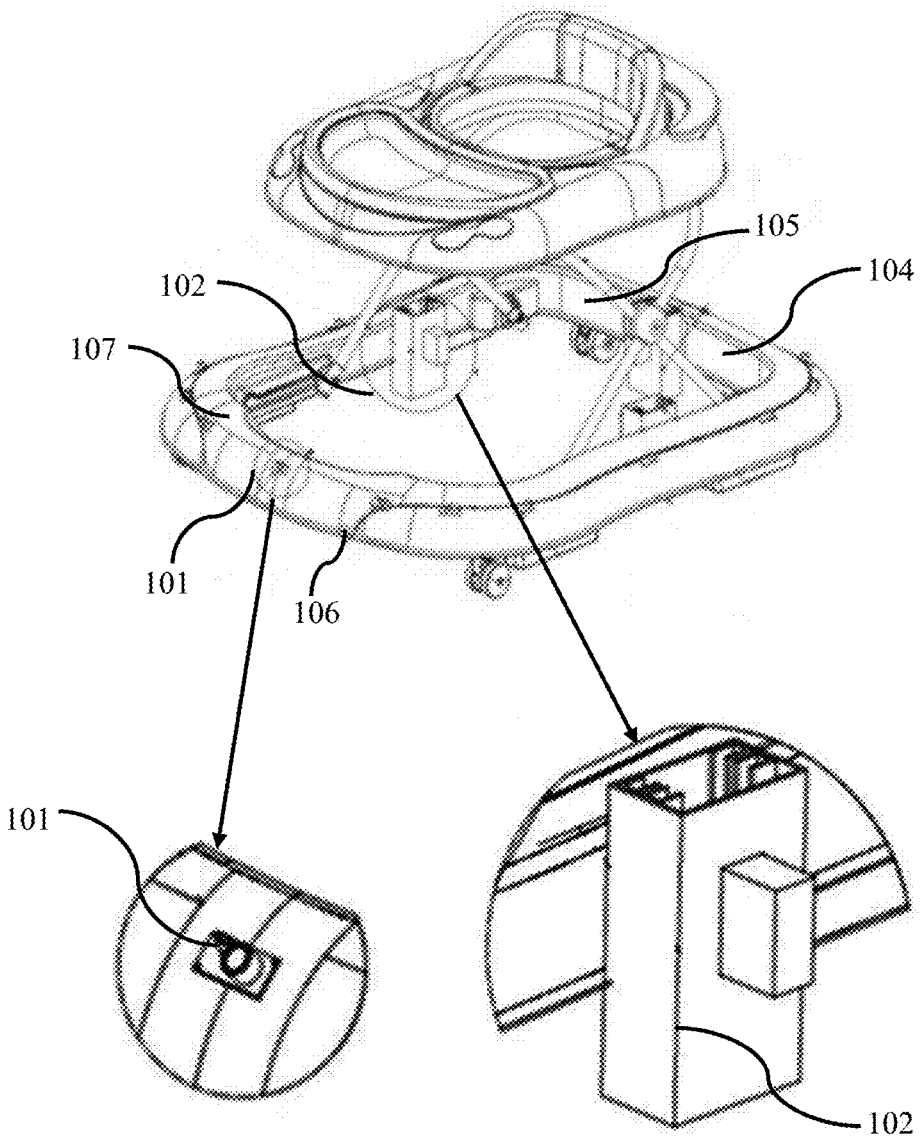
FIG. 1 illustrates a perspective view of a baby walker with braking control mechanism indicating an enlarged view of a sensor unit and a braking unit, according to an embodiment herein.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE EMBODIMENTS HEREIN

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a baby walker with braking mechanism to control a movement of the baby walker from walking into dangerous areas. The baby walker comprises a sensor unit, a wave transmitter system, a braking system and a power supply unit. The sensor unit comprises a plurality of sensors configured to sense an obstacle in the way of walker. The wave transmitter system is in communication with the sensor unit and configured to generate signals on sensing the obstacle. The braking system is in communication with the wave transmitter and configured to control a movement of the walker upon the receipt of the signals from the wave transmitter. The power supply unit is configured to supply electric power to the sensor unit, the wave transceiver the braking system.

According to an embodiment herein, the sensor unit adopts infrared radiations to detect any obstruction to the walker.

According to an embodiment herein, the sensor unit comprises an infrared radiation (IR) transceiver, a flash light and a LED bulb. The infrared radiation (IR) transceiver is configured to generate the infrared rays and to receive the reflected infrared radiations from the obstacle. The flashlight is in communication with IR transceiver and configured to radiate infrared radiations in all possible directions. The flashlight radiates infrared radiations with an adjustable range of 5 cm to 50 cm. The LED bulb is configured to indicate on/off status of the sensor unit.

According to an embodiment herein, a plurality of sensor units are placed on the lower bumper of the walker for enabling a maximum detection of the obstacle. The plurality of sensor units is placed at unsafe surrounding places.

According to an embodiment herein, the sensor unit comprise different types of sensors such as metering sensor, thermal sensors, color sensitive sensors, subsonic sensors; lasers and cameras. The sensor unit further comprises different types of transmitters like infrared, radio and optical transmitters to maximize the detection of obstruction to the walker.

According to an embodiment herein, the wave transmitter comprises a processor configured to analyze the reflected infrared radiations and estimate various parameters pertaining to the obstacle and the walker.

According to an embodiment herein, the wave transmitter transmits an obstacle detection signal to the braking system depending on a distance between the walker and the obstacle. The wave transmitter transmits an obstacle detection signal to the braking system, when the walker gets too close to the obstruction. The wave transmitter further transmits a different signal such as a notification signal to braking system when the walker is moved away from the obstruction.

According to an embodiment herein, the wave transmitter generates a trigger signal to activate an alarm as soon as the brakes are applied to the walker. The alarm turns off when the walker is moved away from the obstacle.

According to an embodiment herein, the braking system comprises a main housing which forms a main body of the braking system, a brake blade configured to inhibit motion of the walker, a brake blade guiding rails to move the brake blade in up and down directions, a rotating disk for enabling the movement of the brake blades, a servomotor configured to control the spinning of the rotating disk and a connecting rod.

According to an embodiment herein, an end part of the brake blade that hits ground surface is covered with silicon or compact plastic for better friction and adherence of the two surfaces.

According to an embodiment herein, the braking system comprises a remote control designed in a way that the brakes are controlled according to the parents/guardian instructions.

According to an embodiment herein, the walker is equipped with a bluetooth system to enable the parents/guardian to check the position of the baby and lock or activate the brakes using electronic device including, but not limited to, cell phone, laptop and computer.

According to an embodiment herein, the power supply unit comprises a battery as a source of power supply, a charging port which is adopted to charge the battery of the walker and a plurality of LEDs to indicate the charging level of the battery.

The various embodiments herein provide a method providing braking mechanism to a baby walker. The method comprises the following steps: The infrared radiations generated by the IR transceiver are radiated in all directions through flashlight. The infrared radiations reflected from the obstacle are received by the IR transceiver. An intimation signal is generated by the wave transmitter and is transmitted to the braking system depending on the reflected radiations received from the IR transceiver. Upon receiving the signal from the wave transmitter, the brakes are applied on the wheels of the baby walker. Further an alarm is generated by the wave transmitter to intimate parents/guardians on the obstruction.

According to an embodiment herein, the detection or notification signal is generated depending on the distance between the baby walker and the obstacle.

According to an embodiment herein, a signal is generated by the wave transmitter to turn off the alarm, when the baby walker is pulled away from the obstacle.

Figure 2:
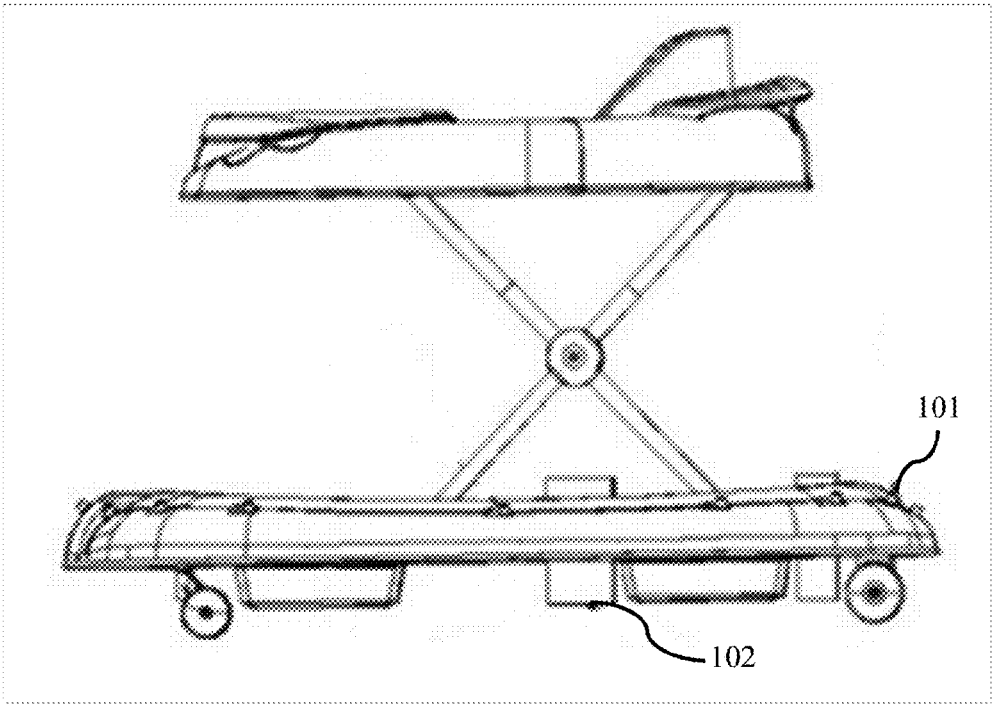
FIG. 2 illustrates a front view and side view of the baby walker with braking control mechanism, according to an embodiment herein.
Figure 2:
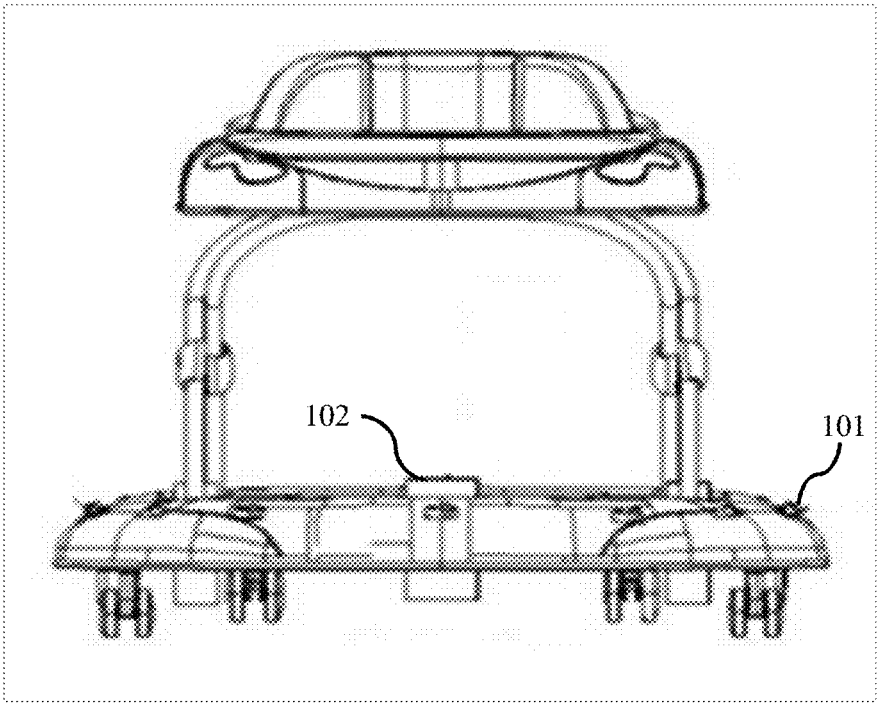

The various embodiments herein provide a baby walker with braking mechanism to control movement of the baby walker from moving into dangerous areas. The baby walker comprises a sensor unit, a wave transmitter system 107, a braking system and a power supply unit 104. FIG. 1 illustrates a perspective view of the baby walker with braking mechanism, according to an embodiment herein. The sensor unit 101 is configured to sense an obstacle in the way of walker. The wave transmitter system 107, in communication with the sensor unit, is configured to generate signals on sensing the obstacle. The braking control system 102, in communication with the wave transmitter, is configured to control movement of the walker upon reception of signals from the wave transmitter. The power supply unit 104 is configured to supply electric power to the sensor unit, the wave transceiver the braking system. FIG. 2 illustrates a front view and a side view of the baby walker with braking mechanism, according to an embodiment herein.

Figure 3:
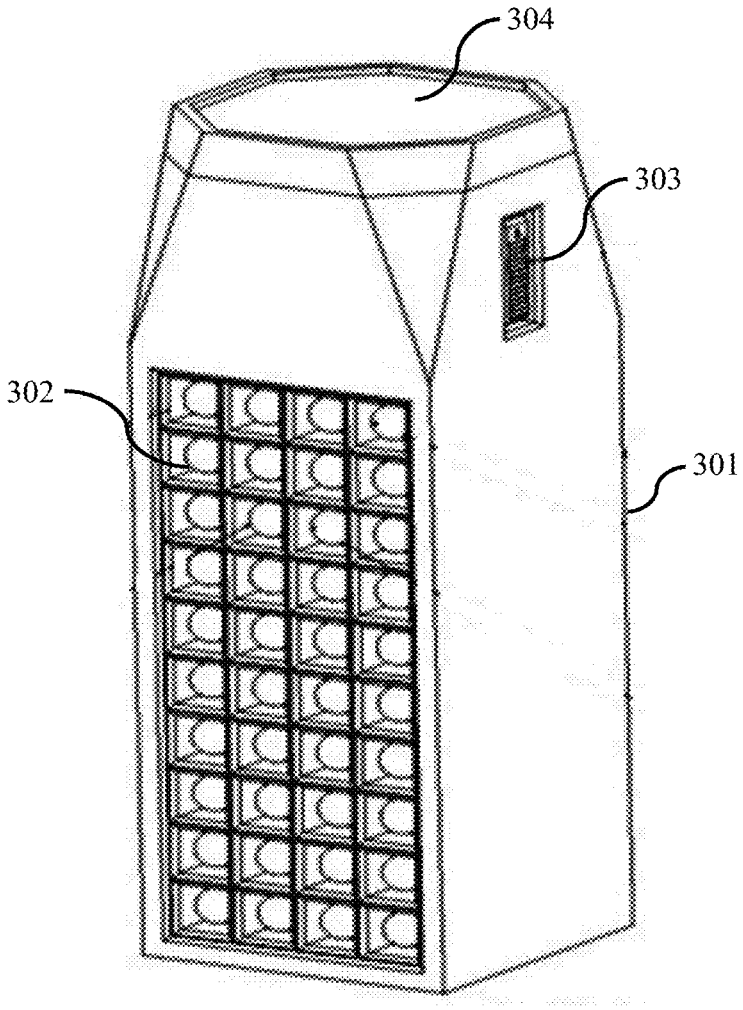
FIG. 3 illustrates a perspective view of a sensor unit of the baby walker with braking mechanism, according to an embodiment herein.

FIG. 3 illustrates a perspective view of the sensor unit of the baby walker with braking mechanism, according to an embodiment herein. The sensor unit further comprises a box with an outer cover 301 provided to house a plurality of flashlights, an infrared radiation transceiver 302 and a LED bulb. The infrared rays are used to detect any obstruction from the obstacle. The LED bulb 303 indicates the on/off status of the infrared sensors. The infrared transceiver 302 is configured to radiate infrared rays in all the directions through flashlight 302. When any obstacle appears in front of the sensor unit, the infrared radiation falling on the obstacle gets reflected. The reflected radiations are collected by the infrared transceiver 302 and are transmitted to the wave transmitter. The infrared source embedded in the flashlight has an adjustable range from 5 to 50 cm. A plurality of sensor units is placed on the baby walker, so as to receive accurate detection of the obstacle. For example, three sensors are placed in front, three sensors are placed in middle and three sensors are used at the end of the walker. The infrared sensors are positioned in the middle of a lower bumper because the front bumper has got a chance of hitting the objects such as wall, chair, etc. When the sensors are placed on the lower bumper, the sensors are not damaged in case the walker hits an object. The sensor units are also placed in certain unsafe places such as stairs, fireplace, kitchen, etc. The sensor unit further comprises various types of sensors, lasers and cameras 106 (as shown in FIG. 1) such as metering sensor, thermal sensors, color sensitive sensors, subsonic sensors and also different types of transmitters like infrared 302, radio 301 and optical transmitters 304 maximize the detection of obstruction to the walker.

The wave transmitter received obstruction reflected infrared radiation from the sensor unit. The wave transmitter comprises a processor 107 (as shown in FIG. 1) which is configured to analyze the reflected radiations and estimate position of the obstacle and the walker. Depending on estimation of distance between the walker and the obstacle, the wave transmitter transmits an intimation signal to the braking system, when the walker gets too close to the obstruction. The wave transmitter further transmits a different signal to braking system when the walker is moved away from the obstruction. The wave transmitter as well activates an alarm 105 (as shown in FIG. 1) as soon as the brakes are applied to the walker. The alarm goes off only when the walker is moved away from the obstacle.

Figure 4:
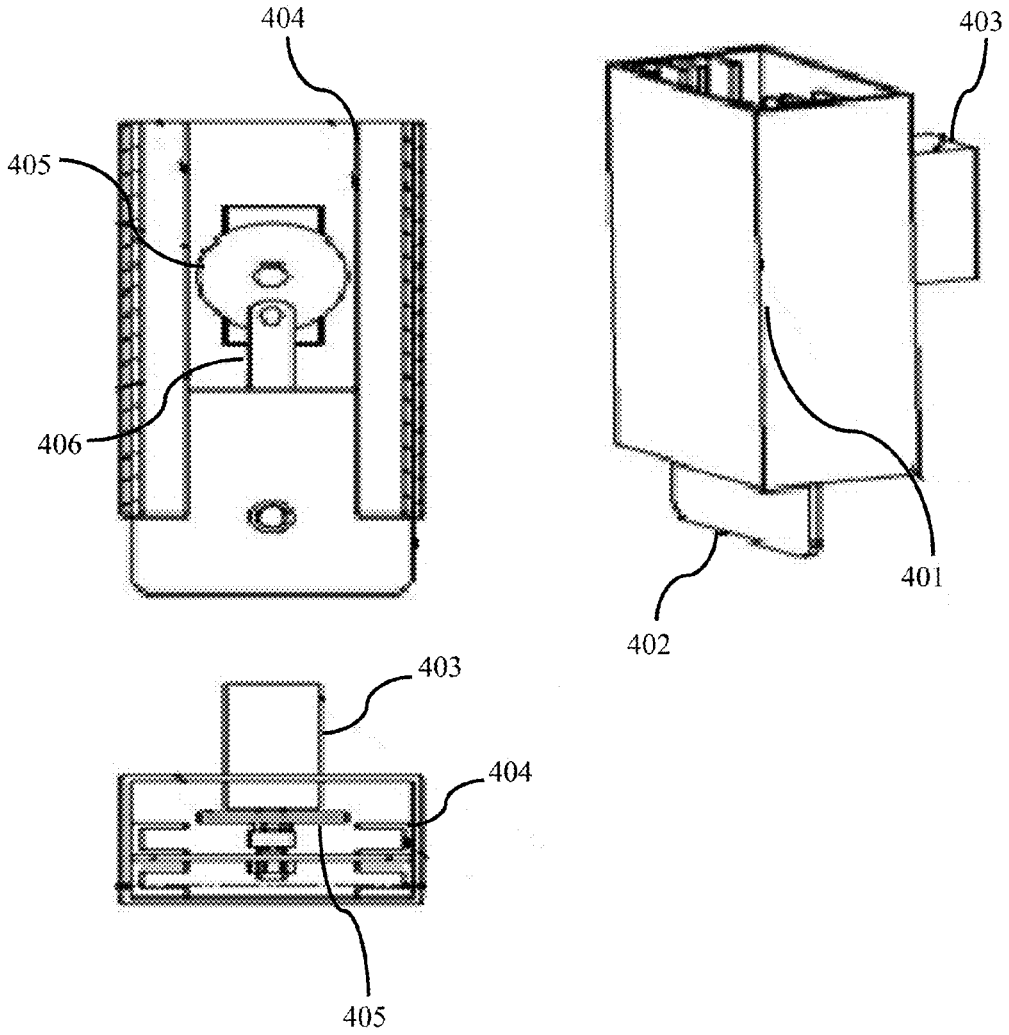
FIG. 4 illustrates a perspective view of a braking system, top view of a braking system and a front view braking system of the baby walker in a cover removed condition, according to an embodiment herein.
Figure 5:
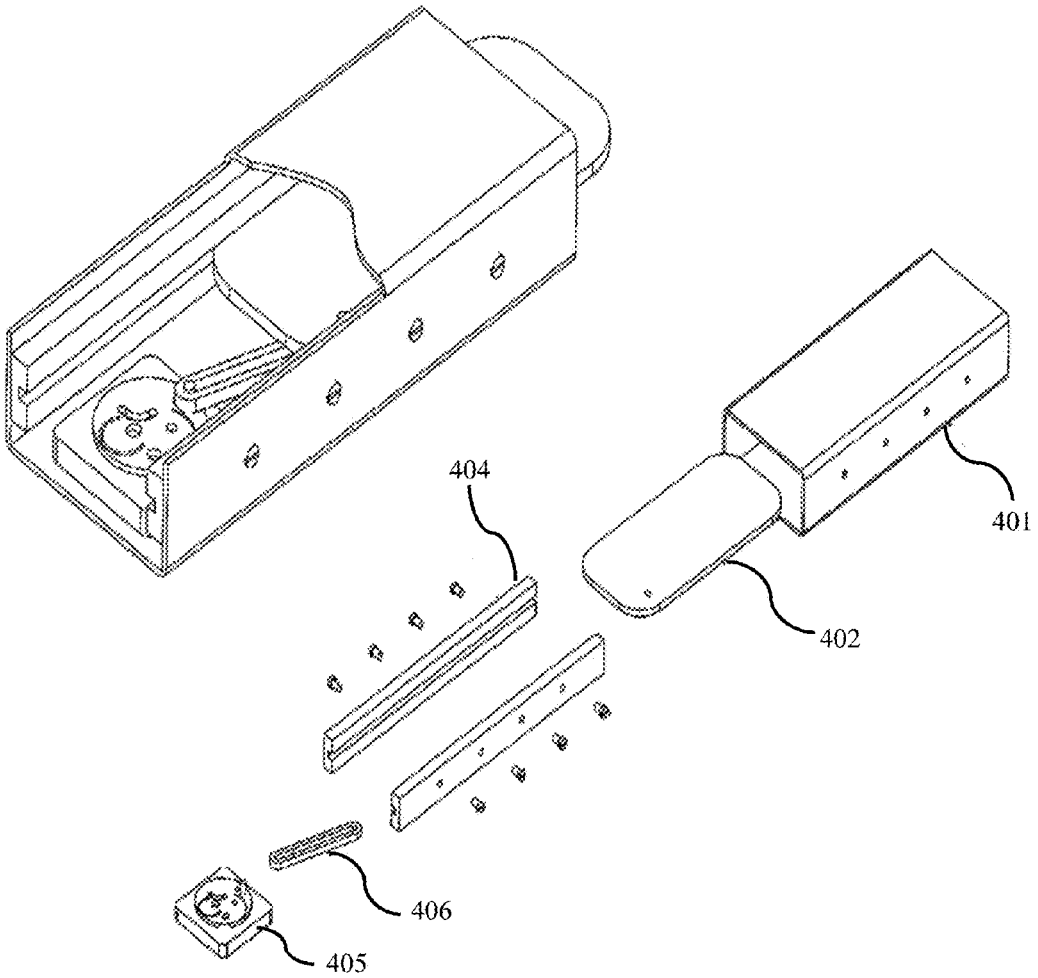
FIG. 5 illustrates an exploded assembly view of the braking system of the baby walker, and a partial cut away view of the braking system according to an embodiment herein.

FIG. 4 illustrates a perspective view of a braking system, a top view of the braking system and a front view of the braking system in a cover removed condition of the baby walker, according to an embodiment herein. FIG. 5 illustrates an exploded assembly view of the braking system of the baby walker, according to an embodiment herein. The braking system of the baby walker comprises a main body 401, a brake blade pad 402, a servomotor 403, a brake blade guiding rails 404, a rotating disk 405 and a connecting rod 406. The servomotor 403 is positioned over the main body 401 which contains the brake blade pad 402, the guiding rails 404, connecting rod 406 and the rotating disk 405 inside it. The brake blade pad 402 is connected to the disc 405 through a connecting rod 406. The brake blade 402 is designed to move along the pair of guide rails 404 fixed to the side walls of the main body 401 and the guide rails 404 are provided inside the main body 401. As the intimation/notification/detection signal is received from the wave transmitter, the servomotor 403 is activated to rotate the rotating disk, which in turn drops down the brake blades through the guiding rails to contact with the floor surface and stop the walker. Silicon plastic is used at the end part of brake blades 402 so that the blades have proper grip to the carpet, tile, etc. The end part of the blade that hits the surface is covered with silicon or compact plastic for better friction and adherence of the two surfaces. When the walker goes further away from the infrared light, the brake blades 402 go up and the walker continues moving. The guiding rails 404 move when the brake blade goes up and down.

The brake system is equipped with remote control and is designed in a way that it is possible to be removed as parents/guardian wish. Further a Bluetooth system is set on the walker which enables the parents/guardian to check the position of the baby and lock or activate the brakes. Further the parents/guardian is able to start or stop the alarm via cell phone, laptop or computer. For this purpose a program is installed on the laptop or cell phone and also the processor of the wave transmitter. The processor is further configured to transmit signals via Bluetooth to the walker in-order to perform various activities such as stop or start order of the brakes, and the alarm order.

The power supply unit of the walker is configured to supply power to the sensor unit, the wave transmitter and the braking system of the walker. A plurality of LED bulbs is placed on the walker to indicate on/off status of the sensors, braking system and battery indicator. The power supply unit comprises a battery as a source of power supply. The power supply unit is adaptable to various kinds of rechargeable AC or DC batteries such as a rechargeable lithium battery. The power supply unit further comprises a charging port which is adopted to charge the battery of the walker. The power supply unit further comprises a plurality of LEDs to indicate the charging level of the battery. For example, three different colored LEDs are used to indicate charging level, where a blue LED indicates full charge; an orange LED indicates medium charge and red LED notifies low battery. By adding to a plurality of the batteries, the various components powered by the batteries work for long-term, hence efficiency of the system is increased.

Figure 6:
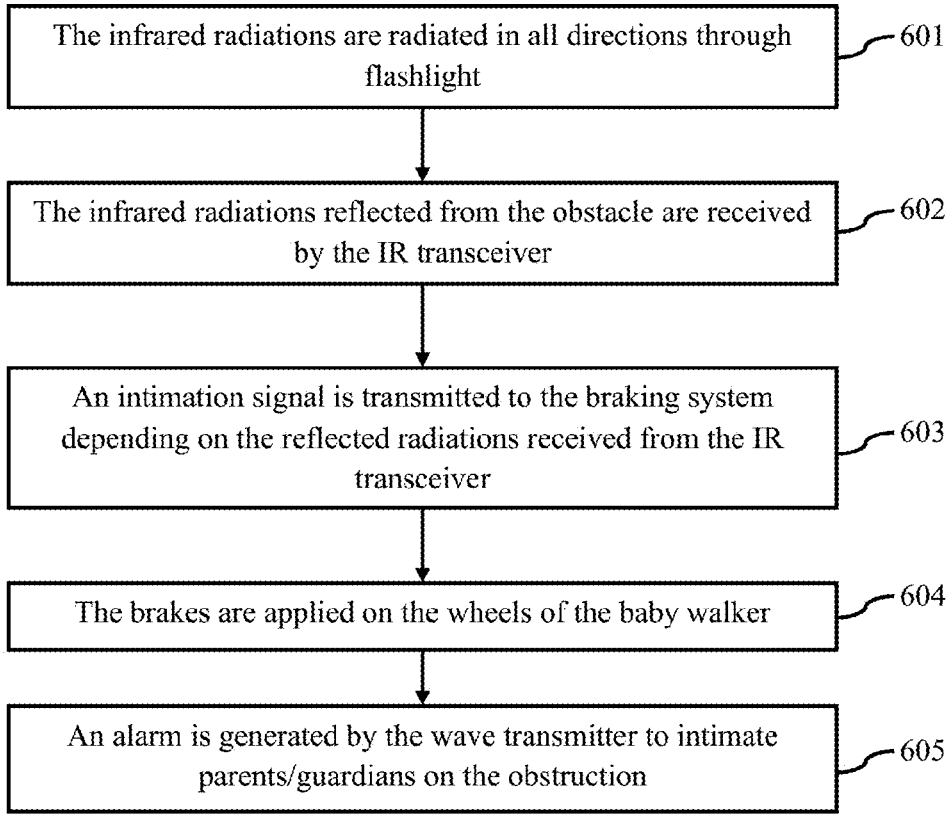
FIG. 6 illustrates a flowchart explaining the steps involved in a method for providing braking mechanism to a baby walker, according to an embodiment of the present disclosure.

The various embodiments herein provide a method providing braking mechanism to a baby walker. FIG. 6 illustrates a flowchart explaining the steps involved in a method for providing braking mechanism to a baby walker, according to an embodiment herein. The method comprises the following steps: The infrared radiations generated by the IR transceiver are radiated in all directions through flashlight (601). The infrared radiations reflected from the obstacle are received by the IR transceiver (602). An intimation/notification/detection signal is generated by the wave transmitter and is transmitted to the braking system depending on the reflected radiations received from the IR transceiver (603). Upon receiving the signal from the wave transmitter, the brakes are applied on the wheels of the baby walker (604). Further an alarm is generated by the wave transmitter to intimate parents/guardians on the obstruction (605).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A baby walker with a braking control system comprises:

a sensor unit configured to sense an obstacle in a way of a walker;

a wave transmitter designed to be in communication with the sensor unit and to generate detection signals on sensing the obstacle;

a braking system in communication with the wave transmitter configured to receive a detection signal from the wave transmitter to control a movement of the walker;

wherein the braking system comprises: a main body for housing a plurality of components of the braking system; a brake blade configured to inhibit a motion of the walker;

a brake blade guiding rail to move the brake blade in up and down directions; a rotating disk for enabling a movement of the brake blades;

a servomotor configured to control rotation of the rotating disk; and a connecting rod; wherein an end part of the brake blade that hits a ground surface is covered with silicon or compact plastic to improve friction and adherence to the ground surface; and a power supply unit configured to supply electric power to the sensor unit, the wave transmitter and the braking system.

2. The baby walker according to claim 1, wherein the sensor unit uses infrared radiations to detect an obstruction to the walker.

3. The baby walker according to claim 1, wherein the sensor unit comprises:

an infrared radiation (IR) transceiver configured to generate infrared rays and to receive reflected infrared radiations from the obstacle;

a light source in communication with IR transceiver, configured to radiate infrared radiations in a plurality of directions, wherein the light source radiates the infrared radiations at an adjustable range of 5 to 50 cm; and a LED bulb configured to indicate on/off status of the sensor unit.

4. The baby walker according to claim 1, wherein a plurality of sensor units are placed on a lower bumper of the walker for enabling maximum detection of the obstacle.

5. The baby walker according to claim 1, wherein the wave transmitter transmits a detection signal to the braking system based on a distance between the walker and the obstacle, and wherein the wave transmitter transmits the detection signal to the braking system, when the walker gets too close to the obstacle, and wherein the wave transmitter transmits a notification signal to the braking system when the walker is moved away from the obstruction.

6. The baby walker according to claim 1, wherein the wave transmitter generates a trigger signal to activate an alarm when the brakes are applied to the walker, wherein the alarm turns off when the walker is moved away from the obstacle.

7. The baby walker according to claim 1, wherein the braking system comprises a remote control designed in a way that the braking system is controlled.

8. The baby walker according to claim 1, wherein the walker is equipped with a Bluetooth system to lock or activate the braking system using a plurality of electronic computing devices and wherein the plurality of electronic computing devices include a phone, laptop computer and computer.

9. The baby walker according to claim 1, wherein the power supply unit comprises: a battery as a source of power supply;

a charging port to charge the battery of the walker; and a plurality of LEDs to indicate the charging level of the battery.

10. A method of providing a braking mechanism for a baby walker, the method comprising: radiating infrared radiations generated by an infrared (IR) transceiver in a plurality of directions through a light source;

receiving reflected infrared radiations from an obstacle by the IR transceiver; generating a detection signal from the reflected radiations received from the IR transceiver;

forwarding the detection signal to a braking system by a wave transmitter;

moving a braking blade to contact a floor surface to stop a movement of the baby walker upon receiving the detection signal from the wave transmitter; and generating an alarm by the wave transmitter; wherein the braking system has a brake blade guiding rail to move the brake blade in up and down directions; a rotating disk for enabling a movement of the brake blade; a servomotor configured to control a rotation of the rotating disk; and a connecting rod; wherein an end part of the brake blade that hits a ground surface is covered with silicon or compact plastic to improve friction and adherence to the ground surface; and a power supply unit configured to supply electric power to a sensor unit, the wave transmitter, and the braking system.

11. The method according to claim 1, wherein the detection signal is generated based on the distance between the baby walker and the obstacle.

12. The method according to claim 1, wherein a notification signal is generated by the wave transmitter to turn off the alarm, when the baby walker is pulled away from the obstacle.

* * * * *